United States Patent [19]

Vogel et al.

[11] Patent Number: 4,803,834

[45] Date of Patent: Feb. 14, 1989

[54] TEXTILE SPINDLE

[75] Inventors: Walter Vogel, Niederwerrn; Wolfgang Schmucker, Hammelburg; Erwin Leurer, Fuchsstadt, all of Fed. Rep. of Germany; Francois Beel, Lockeran, Belgium

[73] Assignees: FAG Kugelfischer Georg Schafer (KGaA), Fed. Rep. of Germany; N.V. Van der Eecken & Co., Belgium

[21] Appl. No.: 135,844

[22] Filed: Dec. 21, 1987

[30] Foreign Application Priority Data

Dec. 22, 1986 [DE] Fed. Rep. of Germany ..... 3643932

[51] Int. Cl.[4] ..... D01H 1/244

[52] U.S. Cl. ..... 57/308; 57/92; 57/304

[58] Field of Search ..... 57/308, 304, 59, 66, 57/67, 92, 100

[56] References Cited

U.S. PATENT DOCUMENTS

| | | | |
|---|---|---|---|
| 3,086,348 | 4/1963 | Fowler et al. | 57/308 X |
| 3,217,483 | 11/1965 | Kato et al. | 57/308 X |
| 3,875,228 | 12/1974 | Nakahara et al. | 57/308 X |
| 4,055,937 | 11/1977 | Latus et al. | 57/308 |
| 4,112,663 | 9/1978 | Chrtek et al. | 57/100 X |
| 4,679,389 | 7/1987 | Wolf | 57/308 X |

*Primary Examiner*—Donald Watkins

*Attorney, Agent, or Firm*—Ostrolenk, Faber, Gerb & Soffen

[57] ABSTRACT

The jacket enclosing a motor driven textile spindle of the type wherein the spindle is driven by a separate motor which is mounted on a common base with the spindle is modified to include air inlet and air exit openings. The motor is located in proximity to the spindle and is coupled to it by a toothed belt or the like. As the spindle is rotated by the motor air is drawn in through the inlet opening of the spindle and exits through the exit openings in the form of a strong stream of air which blows on and cools the motor. In this manner the spindle doubles as a fan for the motor and the necessity of providing a separate fan for the motor is avoided, resulting in savings in space and energy for driving a fan.

13 Claims, 5 Drawing Sheets

TEXTILE SPINDLE

BACKGROUND OF THE INVENTION

The present invention relates to a motor driven textile spindle wherein the motor of the spindle and the spindle are mounted on a common base plate and the motor drives the spindle via a toothed belt or the like.

A spinning or winding spindle is known which is provided with a rotating or stationary pot-shaped jacket or enclosure around it. The jacket's primary function is to limit the effect of ballooning. It also reduces power consumption. Typically, air is forced or drawn through the jacket in order to prevent fluff which is produced within the spindle from attaching itself to the winding thread If the fluff were not to be removed it could form itself into so-called pills or hairpins and this could mar the appearance of the thread or even lead to its breakage.

A motor-driven textile spindle of the type referred to herein is known from German Laid-open Patent Application OS No. 28 20 816. The known motor-driven spindle has the disadvantage that its motor often overheats, particularly during starting of the spindle. Since spindle motors must be very compact, it is simply impractical to add a fan to cool the motor.

SUMMARY OF THE INVENTION

It is an object of the present invention to provide a motor-driven textile spindle which solves the problem of motor overheating.

It is a further object of the present invention to provide cooling for the motor of a motor-driven textile spindle by means which do not require additional space for a fan or energy for driving it.

The foregoing and other objects of the invention are achieved by providing a spindle system having the characteristic features of the claims which follow. In accordance with the present invention the pot-shaped jacket which is normally provided around the spindle is modified to include air inlet and exit openings. As the spindle rotates at high speeds, air is drawn into the jacket and thereafter expelled as a strong stream of air which is guided and directed onto the motor to cool it.

In a preferred embodiment, the invention includes guide plates disposed on and about the air exit openings in the jacket The guide plates guide the stream of air toward the motor to optimize the cooling effect.

Thus, the present invention realizes the objective of providing cooling air to the motor of a spindle without requiring extra space or energy for rotating a cooling fan.

In accordance with a further embodiment, the pot-shaped jacket also includes an opening at its top. Thus, a portion of the air drawn into jacket by rotation of the spindle for cooling the motor is deflected toward the open top of the jacket of the spindle. This secondary jet of air provides additional cooling air which passes over a drawing frame and/or feed elements which are typically arranged within the enclosure or jacket of a spindle.

Other features and advantages of the present invention will become apparent from the following description of preferred embodiments of the invention which description refers to the following drawings.

BRIEF DESCRIPTION OF THE DRAWINGS

FIG. 8 is a cross-section through the pot-shaped jacket of FIG. 7.

DETAILED DESCRIPTION OF PREFERRED EMBODIMENTS

Figure 1:
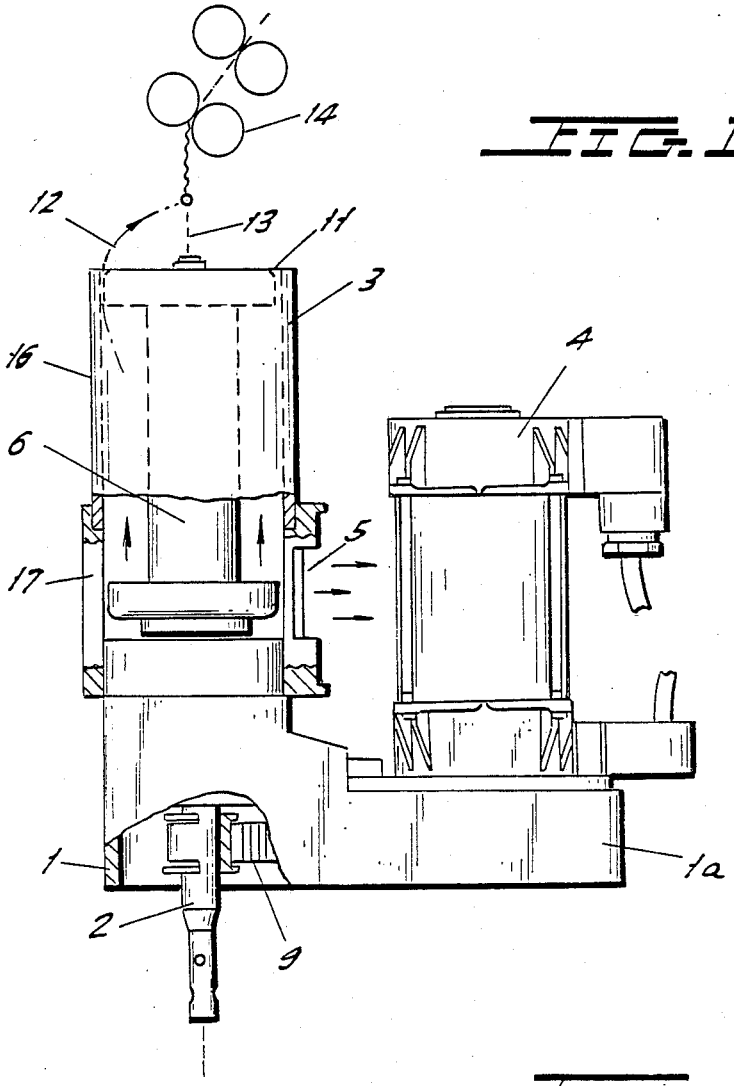
FIG. 1 is a side view, partially in section, of a winding spindle and associated drive motor in accordance with the present invention.

Referring to FIG. 1, a motor 4 and a spindle 2 are both mounted on a common base plate 1*a*. Spindle 2 is coupled to and driven by motor 4 via a toothed belt 9. A bobbin 6 is supported on the spindle 2 and the bobbin 6 is surrounded by a stationary, pot-shaped, jacket or enclosure 3. A first thread 12 issues from the spindle 2 and is wound about a core thread 13. The threads 12 and 13 are either stretched in a stretching roller mechanism 14 as shown in FIG. 1 or are simply supplied via a double roller supply mechanism 15 as shown in FIG. 3.

Figure 2:
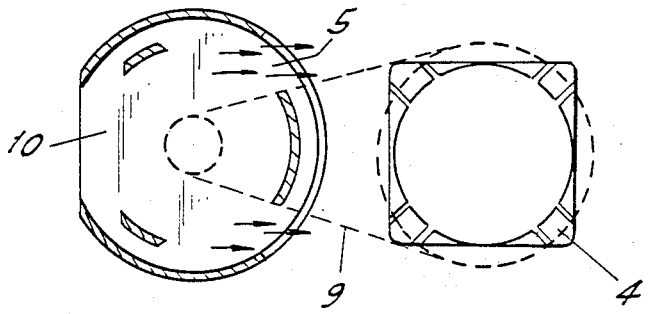
FIG. 2 is a top view of the winding spindle and motor of FIG. 1.

The jacket 3 is open at its top 11 and is provided with a plurality of air exit openings 5 through which a jet of air, produced by rotation of spindle 2, is directed toward the motor 4. As seen in FIG. 2, the air exit openings 5 in the pot-shaped jacket 3 face toward the motor 4. The air flowing through the openings 5 is drawn into jacket 3 through an inlet opening 10 which is disposed on the jacket 3 at a location thereof facing away from the motor 4.

Figure 3:
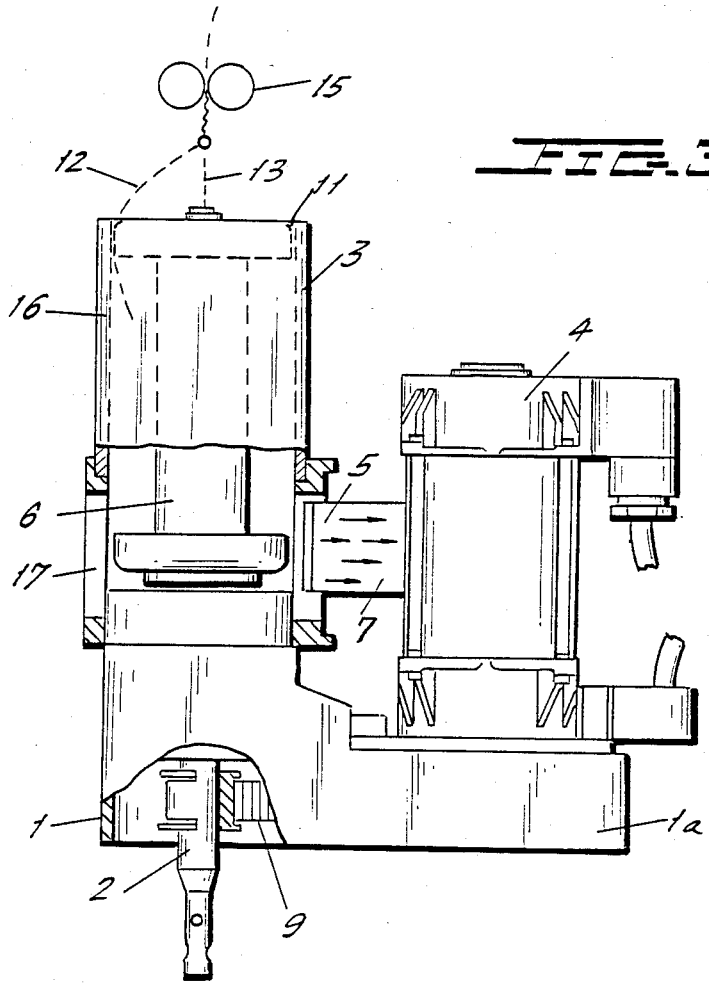
FIG. 3 is a side view, partially in section, of a winding spindle and associated motor, further including guide plates in accordance with a second embodiment of the present invention.

FIG. 3 illustrates a further embodiment of the present invention which is subtantially similar to the embodiment of FIG. 1 but which adds the guide plates 7 which extend between the spindle 2 and the motor 4 and which more carefully guide the air onto the motor 4. As seen in the top view of FIG. 4, the guide plates 7 are comprised of a first conduit 7*a* which is formed by an outer side wall 7*c* and an inner side wall 7*b* and a second conduit 8*a* which is comprised of an outer side wall 8*c* and an inner side wall 8*b*. Thus, the air flows through the conduits 7*a* and 8*a* toward the motor 4.

Figure 4:
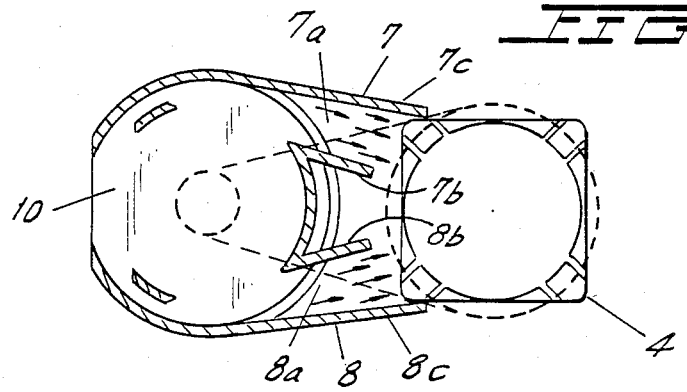
FIG. 4 is a top view of FIG. 3.
Figure 5:
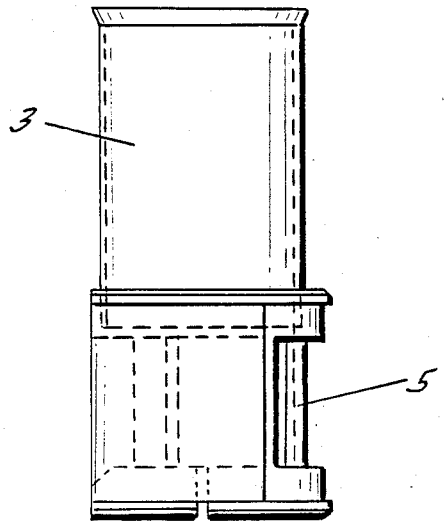
FIG. 5 illustrates a pot-shaped jacket disposed around the winding spindle illustrated in the previous Figures.
Figure 6:
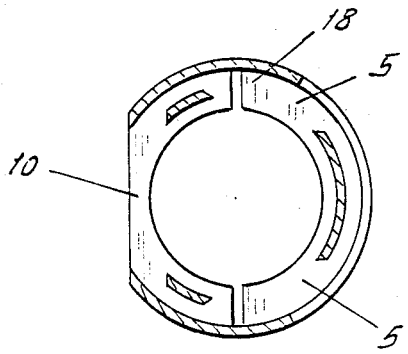
FIG. 6 depicts a cross-section through the pot-shaped jacket of FIG. 5.
Figure 7:
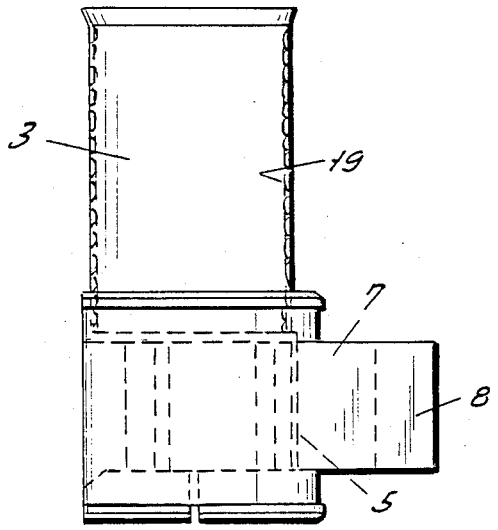
FIG. 7 illustrates the jacket of FIG. 5, which is further modified to include guide plates.
Figure 6:
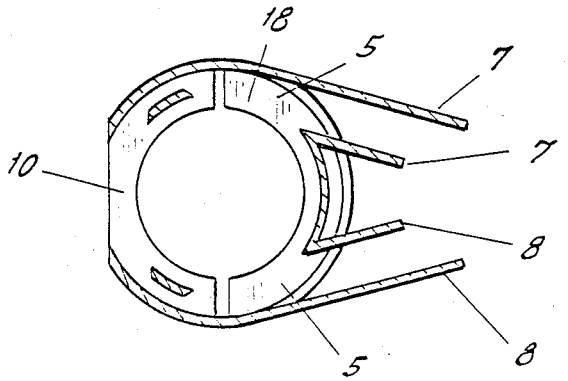

In the embodiment of FIG. 5, the pot-shaped jacket 3 having its exit openings 5 through which air is directed toward the motor 4 is shown separately of the motor 4. The construction of the pot-shaped jacket 3 in FIG. 5 is illustrated in cross-section in FIG. 6. Similarly, the embodiments of FIGS. 3 and 4 are repeated in FIGS. 7 and 8 where the construction of the spindle 3 and particularly the guide plates 7 and 8 are illustrated separately of the base plate 1*a* and the motor 4.

Figure 9:
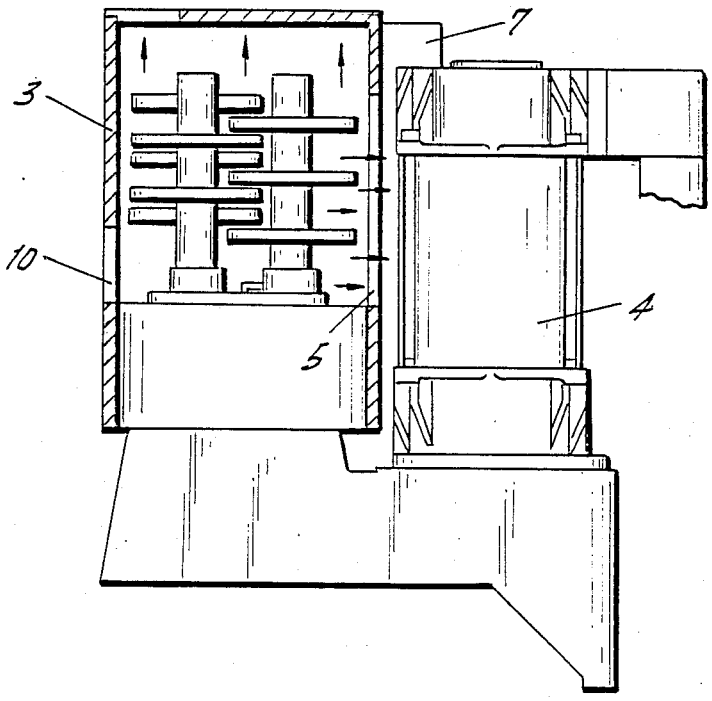
FIG. 9 illustrates a jacket around a motor-driven friction disk unit in accordance with another embodiment of the present invention.
Figure 10:
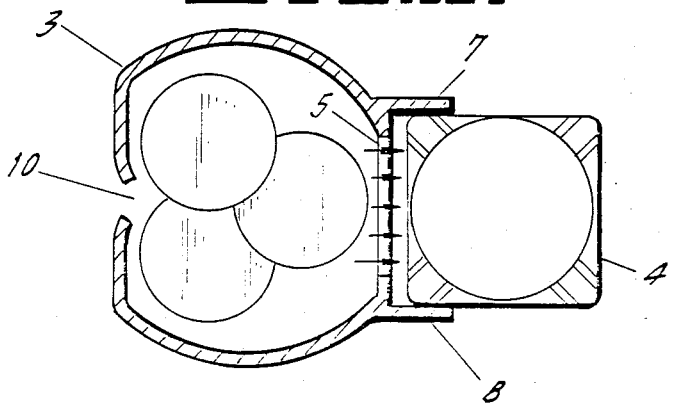
FIG. 10 is a top view of the friction disk unit of FIG. 9.

The concept of the present invention is also applicable to a motor-driven friction disk unit which is illustrated in FIGS. 9 and 10. In the illustrated embodiment, air is drawn into the jacket 3 surrounding the friction disk unit through opening 10. Thereafter, the air in the jacket 3 is expelled through the air exit openings 5 which extend vertically along that portion of the wall of jacket 3 which faces the motor 4. Thus, the motor 4 is cooled without a dedicated fan and without expending energy for powering a fan. Note too, that the jacket 3 is open at the top and a portion of the air flows upwardly.

In the above-described embodiments, the jacket 3 may include an upper portion 16 and a lower portion 17, the lower portion 17 being disposed about a lower part of the bobbin 6 of the spindle 2. The lower portion of the jacket 3 may be constituted of a double jacket 18 as seen in FIG. 8. Preferably, the inner jacket has an inner jacket sleeve which is comprised of a high-grade material having an extremely high surface finish. The high grade material may be a high-quality steel with a large percentage of chromium so that it is stainless.

The spindle 2 is further provided with a thread contacting surface and an inner uniformly dented member 19 extending around the entire circumference of the inner contacting surface for accommodating the thread 12 which is formed by the spindle 2. As previously noted, the jacket 3 may be in the shape of a pot and the pot has an open upper end. This results in a secondary stream of air which clears fluff and prevents formation of pills or hairpins on the thread.

Although the present invention has been described in connection with preferred embodiments thereof, many other variations, modifications and other uses will now become apparent to those skilled in the art. It is preferred, therefore, that the present invention be limited not by the specific disclosure herein, but only by the appended claims.

What is claimed is

1. A spindle system, comprising:

a textile spindle;

a motor disposed in proximity to the spindle and coupling means for coupling the motor to the spindle in a manner which enables the motor to rotate the spindle, and rotation of the spindle causing air to move past the spindle;

a stationary jacket disposed about the spindle, the jacket including air inlet opening means for enabling air to enter into the jacket in response to rotation of the spindle and air exit opening means for allowing air drawn into the jacket to exit therefrom upon rotation of the spindle and for directing that exiting air to flow toward the motor.

2. A spindle system according to claim 1, wherein the air exit opening means include a plurality of openings defined in the jacket and including guide plates disposed about the exit opening means and extending outwardly away from the jacket toward the motor.

3. A spindle system according to claim 2, wherein the guide plates partially surround the motor.

4. A spindle system according to claim 3, in which the jacket includes an upper portion and a lower portion, the lower portion being disposed about a lower part of a bobbin associated with the spindle and wherein the jacket is constituted in its lower part of a double jacket.

5. A spindle system according to claim 4, in which the double jacket comprises an inner jacket sleeve which is comprised of a high-grade material having an extremely high surface finish.

6. A spindle system according to claim 5, wherein the high-grade material is constituted of high quality steel having a large predetermined percentage of chromium therein.

7. A spindle system according to claim 3, wherein the jacket comprises a thread contacting surface and further comprises an inner uniformly dented member extending around its entire circumference for accommodating a thread.

8. A spindle system according to claim 3, wherein the jacket is in the shape of a pot, the pot having an open upper end, a portion of the air entering through the inlet opening means exiting through the open upper end.

9. A spindle system according to claim 1, wherein the coupling means comprises a toothed belt.

10. A spindle system according to claim 1, wherein the air exit means including two openings.

11. A spindle system according to claim 1, further comprising a stretching mechanism for stretching threads issuing from the spindle system.

12. A spindle system, comprising:

a textile spindle;

a motor disposed in proximity to the spindle and coupling mesans for coupling the motor to the spindle in a manner which enables the motor to rotate the spindle, and a stationary jacket disposed about the spindle, the jacket including air inlet opening means for enabling air to enter into the jacket in response to rotation of the spindle and air exit opening means for allowing air drawn into the jacket to exit therefrom upon rotation of the spindle and for directing that exiting air to flow toward the motor;

the jacket comprising a thread contacting surface and an inner uniformly dented member extending around its entire circumference for accommodating a thread.

13. A spindle system, comprising:

a textile spindle;

a motor disposed in proximity to the spindle and coupling means for coupling the motor to the spindle in a manner which enables the motor to rotate the spindle, and a stationary jacket disposed about the spindle, the jacket including air inlet opening means for enabling air to enter into the jacket in response to rotation of the spindle and air exit opening means for allowing air drawn into the jacket to exit therefrom upon rotation of the spindle and for directing that exiting air to flow toward the motor;

the jacket being in the shape of a pot, the pot having an open upper end, a portion of the air entering through the inlet opening means exiting through the open upper end.

* * * * *